United States Patent [19]

Tillson

[11] 4,181,464

[45] Jan. 1, 1980

[54] REFUSE VEHICLE LOADING APPARATUS

[75] Inventor: Thomas W. Tillson, Knebworth, England

[73] Assignee: Shelvoke and Drewry Limited, Letchworth, England

[21] Appl. No.: 865,005

[22] Filed: Dec. 27, 1977

[51] Int. Cl.[2] ..... B65F 3/00

[52] U.S. Cl. ..... 414/501; 414/525

[58] Field of Search ..... 214/83.3, 503, 518; 414/472, 501, 525

[56] References Cited

U.S. PATENT DOCUMENTS

| | | | |
|---|---|---|---|
| 2,151,887 | 3/1939 | Barrett | 214/83.3 |
| 2,703,184 | 3/1955 | Barrett | 214/83.3 X |
| 2,837,230 | 6/1958 | Herterich | 214/83.3 X |
| 3,878,949 | 4/1975 | Colin | 214/83.3 |

*Primary Examiner*—Robert G. Sheridan

*Attorney, Agent, or Firm*—Lane, Aitken & Ziems

[57] ABSTRACT

A refuse collection vehicle of the type comprising a hopper which is movable between a first position in which refuse may be loaded into the hopper and a second position in which the refuse in the hopper may be transferred to a storage chamber within the body of the vehicle by packer means comprising a pivotally mounted plate or series of prongs which is movable from one end of the hopper to the other to push refuse from the hopper into the storage chamber characterized in that the hopper has a curved base which, when the hopper is in its first position, extends upwardly both forwardly and rearwardly from the lowest point of the hopper so that refuse is retained in the curved base the arrangement being such that when the hopper is in its second position, the packer means is located with its outer or free edge at the rear edge of the curved base of the hopper, the discharge or 'push' stroke of the packer means being such as to cause the outer or free edge of the packer means to move in a path which is substantially coincident with the curved hopper base.

5 Claims, 2 Drawing Figures

2
10
18
38
4'
40
20
22
30
28
16
46
42
48
6
4
44
32
34
12
8
14

REFUSE VEHICLE LOADING APPARATUS

FIELD OF THE INVENTION

This invention relates to refuse collection vehicles and, in particular, to apparatus for loading refuse under pressure into the storage chamber of such vehicles.

BACKGROUND TO THE INVENTION

Hitherto, refuse has been loaded from a hopper which in movable between a first position in which refuse may be loaded into the hopper and a second position in which the refuse in the hopper may be transferred to the storage chamber by packer means, comprising a pivotally mounted plate or series of prongs, which is movable through a discharge stroke to push the refuse from the hopper and pack it under pressure into the chamber. Such apparatus will hereafter be referred to as "loading apparatus of the type described."

Known apparatus of the type described is arranged so that as the hopper is moved to the second position, the packer means is situated so that its outer or free edge digs into the refuse at the rear of the hopper. The packer means is subsequently moved forwardly so as to push the refuse from the hopper into the chamber.

BRIEF DESCRIPTION OF THE INVENTION

Loading apparatus of the type described, in accordance with the invention, is characterised in that the hopper has a curved base, which, when the hopper is in its first position, extends upwardly, both forwardly and rearwardly, from the lowermost point of the hopper so that refuse is retained in the curved base, and is movable to an upper discharge, or second, position in which the packer means is located with its outer or free edge at the rear edge of the curved base of the hopper, the discharge stroke of the packer means being such as to cause the outer or free edge of the packer means to move in a path which is substantially coincident with the curvature of the hopper base.

This enables the hopper to be moved to the second position without the need for the outer edge of the packer means to dig into the refuse, so that less force is needed to move the hopper. Also, the packer means may sweep over the whole surface of the hopper, enabling substantially all the refuse to be removed from the hopper, whereas in known apparatus, refuse could be left behind the packer means as it dug into the main bulk of refuse in the hopper, and such refuse would not be discharged from the hopper by the packer means.

The hopper base preferably has the shape of a part-cylinder, the axis of which is coincidental with the pivot axis of the packer means when the hopper is in the second position, the length of the packer means from its pivot axis to its outer edge being substantially equal to the radius of the cylinder.

Preferably, there is a small clearance, for example ½", between the outer edge of the packer means and the base of the hopper as the outer edge sweeps over the hopper base.

The hopper may be mounted in a "tail gate", which is pivotally mounted to the rear of the body of the refuse vehicle for upward and forward movement for removal of the refuse, as is known in the art.

Preferably, the sides of the hopper are situated inwardly of the side walls of the tail gate, so that the whole of the hopper, including the sides, may be swept by the packer means, while the latter is kept clear of the side walls of the tail gate.

In accordance with a further feature of the invention apparatus for loading refuse into the storage chamber of a refuse vehicle comprises a hopper into which refuse may be loaded and packer means to transfer the refuse from the hopper to the storage chamber, the packer means being movable by hydraulic jacks located outside the side walls of the vehicle (or a tail gate attached thereto) so as to avoid contact between the hydraulic jacks and the refuse.

This avoids contamination and potential blockage of the hydraulic jacks by the refuse.

DESCRIPTION OF THE PREFERRED EMBODIMENT

Figure 1:
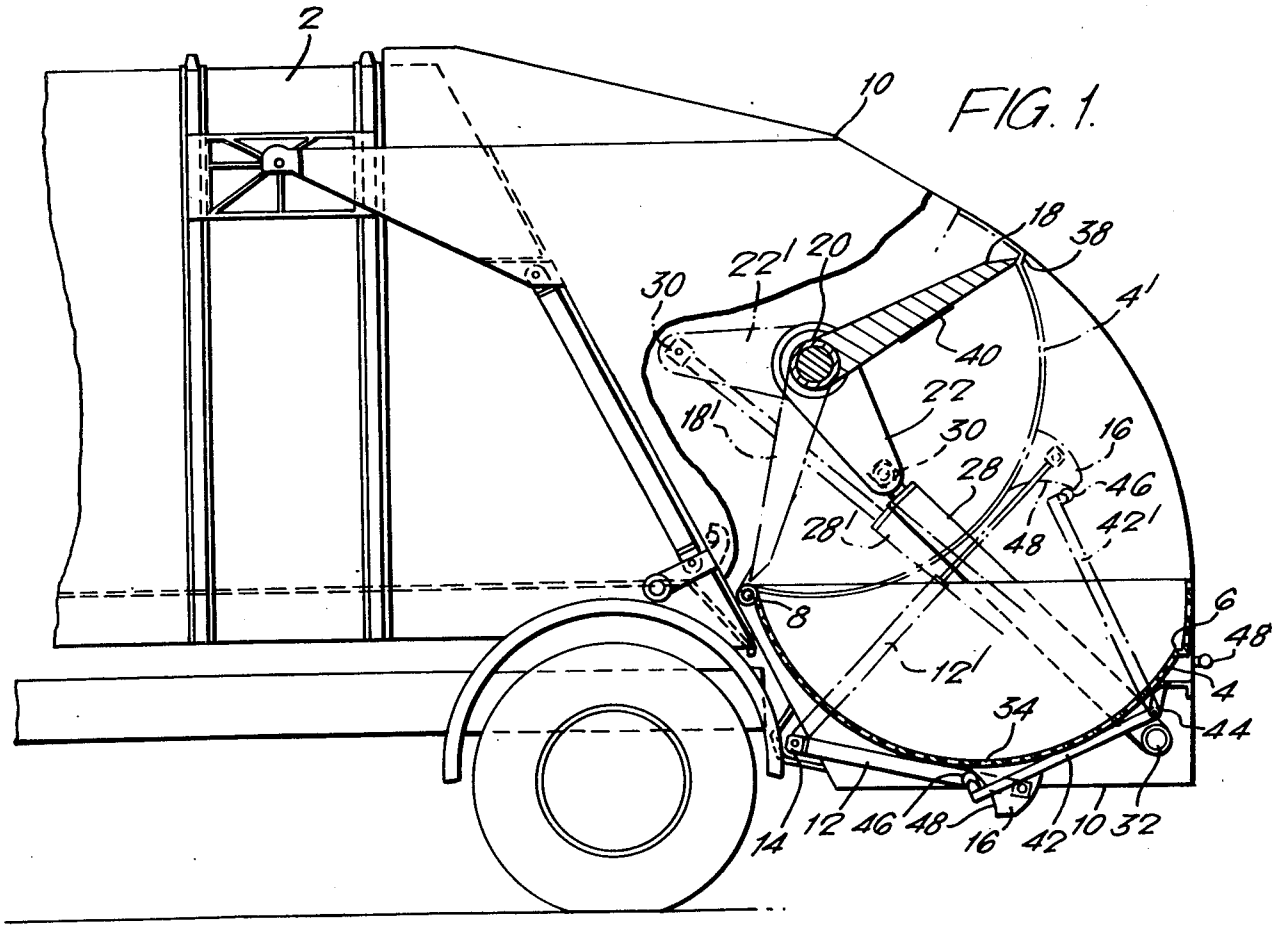
Figure 2:
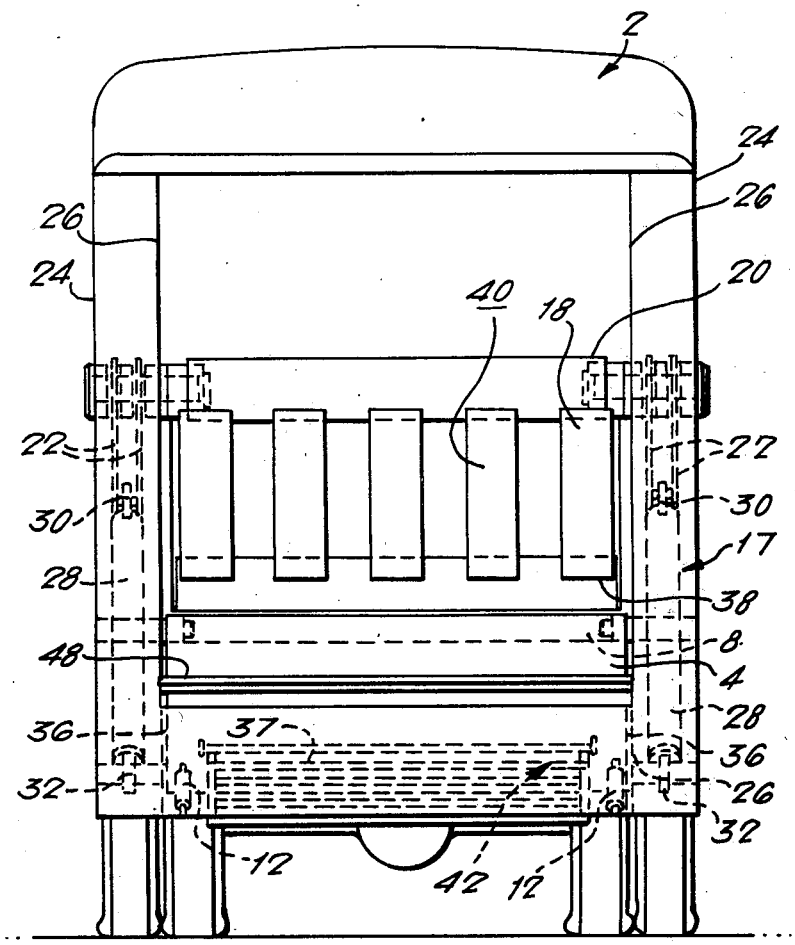

The invention will now be further described by way of example, with reference to the accompanying drawings in which;

FIG. 1 is a schematic side view of one embodiment of loading apparatus in accordance with the invention in position on a refuse collection vehicle, and FIG. 2 is a rear view of the vehicle shown in FIG. 1.

The loading apparatus is connected to the rear end of a refuse collection vehicle 2, and comprises a hopper 4 for reception of refuse having a loading bar 6 and being pivotally mounted on an axle 8 attached to the vehicle tail gate portion 10.

Each of a pair of hydraulic jacks 12 is pivotally mounted between the tail gate at 14 (one at each side of the hopper) and a downwardly depending member 16 fixed to the bottom of the hopper 4. Extension of the jacks 12 causes the hopper 4 and jacks 12 to swing upwardly to their second position as indicated at 4' and 12' respectively in FIG. 1.

A packer plate 18, which may have a series of prongs, or teeth (or may be plain) is pivotally mounted on an axle bar 20 located above the second position of the hopper 4. A pair of arms 22 is fixedly mounted at each end of the bar 20, between outer and inner side walls 24 and 26 of the tail gate 10 (see FIG. 2) and on the other side of the inner side walls 26 from the packer plate 18. A pair of hydraulic jacks 28 is pivotally fixed at 30 to the ends of the arms 22 respectively, the other ends of the jacks 28 being pivotally attached to the tail gate at 32. Alternate exhaustion and introduction of fluid from and to hydraulic jacks 28 causes the jacks arms 22 and packer plate 18 to reciprocate to and from their positions as indicated by dash lines 28', 22' and 18' respectively.

The base 34 of the hopper 4 is curved so that it has the shape of a part-cylindrical surface. The side walls 36 of the hopper are positioned inwardly of the side walls 26 of the tail gate, (as can be seen in FIG. 2) and the width of the packer 18 is substantially equal to that of the hopper 4.

Operation of the loading apparatus is as follows: Refuse is loaded into the hopper 4 while it is in its first and lower position and fluid is exhausted from hydraulic jacks 28 to pivot the jacks, toothed packer plate 18 and arms 22 to the raised position of the packer plate as shown in full lines in FIG. 1.

At the same time pressure fluid is introduced into the hydraulic jacks 12 to pivot the hopper upwardly to its second upper, tilted position at 4'.

The second position of the hopper is such that the axis of curvature of its base 34 is coincident with the axis of the axle bar 20. The distance between this axis and the outer edge 38 of the teeth of the toothed packer plate 18 is thus substantially equal to, or slightly less than, the radius of the curvature of the base 34 of the hopper 4.

It will be appreciated that movement of the hopper to its second position causes the top rear edge of the curved base of the hopper to be aligned with the edge 38 of the packer plate so as to bring the refuse in the rear of the hopper toward the flat fronts 40 of the teeth of the packer plate 18, avoiding the necessity of digging the edge of the plate into the refuse.

When the hopper has reached its second position, fluid is introduced into the jacks 28, thus causing the packer plate 18 to move to its lowermost position, with its outer edge 38 sweeping over the base 34 of the hopper to push refuse from the hopper into a storage chamber within the body of the vehicle.

The sides of the packer plate sweep over the side walls 36 of the hopper, but are spaced from the side walls 26 of the tail gate.

The fluid in the jacks 10 can then be exhausted to lower the hopper 4, ready to receive a further load of refuse.

The operation of the loading apparatus is automatic, so that an operator need only initiate the operation by, for example, pressing a button, for fluid to be introduced into and exhausted from the jacks in the correct sequence. However, there is also provided means to operate separately on the one hand the jacks 12, and on the other hand the jacks 28. This is advantageous when large objects are to be loaded in the body. An object loaded into hopper 4 may be so large that, as the hopper is raised by jacks 12, it blocks the path of the packer plate as the latter is moved by jacks 28 to the position shown at 18. In this case, the jacks 28 can first be operated to move the packer plate, and the hopper is then lifted by jacks 12, after the packer plate has reached its upper position as shown at 18'. The jacks 28 are then operated to cause the plate 18 to sweep the object from the hopper 4 into the storage chamber of the vehicle.

Alternatively the hopper 4 can be lowered by the jacks 12 when the cycle is part-complete, leaving packer plate 18 at its upper position. Hopper 4 can now be loaded and again lifted by jacks 10.

The hydraulic jacks 28, because they are located on the outside of the inner side walls 26, do not come into contact with the refuse. The jacks 12 also avoid contact with the refuse as they are positioned outside the hopper 4.

The tail gate 10 is provided with a safety barrier or guard 42 of generally rectangular, rigid sheet or mesh, which is pivotally mounted at one edge to the tail gate, as indicated at 44. The opposite edge of the guard 42 is provided with rollers or castors 46, and the guard is biassed clockwise (as shown in FIG. 1) by two tension springs (not shown) so that the castors 44 engage a cam surface 48 on the member 16 fixed to the underside of the base 34 of the hopper. As the jacks 12 lift the hopper to its second position shown at 6' the guard 42 pivots in a clockwise direction, with the castors 46 following the cam surface 48, until it reaches the position shown at 42' in FIG. 1. In this position the guard prevents anyone from gaining access to the underneath of the hopper, which could be extremely dangerous. The tension springs biasing the guard 42 are very strong, so that an operator cannot manually move the guard, and so that it will not move if anyone accidentally falls onto it. A stop bar 48 mounted across the rear of the tail gate, just below the loading rail 6 of the hopper provides a further safety feature. Any movement of this bar will stop the packing cycle until such time as the operator deems it safe to re-start the mechanism. The position of the bar is such that anyone falling against, under or into the hopper must move the bar, thereby stopping the mechanism.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

What is claimed is:

1. A refuse collection vehicle of the type having a refuse loading apparatus connected to said vehicle, said loading apparatus comprising a hopper and packing means, said hopper being pivotally mounted to pivot between a first position in which refuse may be loaded into the hopper and a second position in which the refuse may be transferred to a storage chamber within the body of the vehicle by said packing means, said hopper having a curved base formed in the shape of a partial cylinder about an axis, said base extending upwardly both forward and rearward from the lowest point of the hopper when the hopper is at its first position so that refuse is retained in the curved base, said packing means including a pivotally mounted scoop adapted to pivot about an axis and to move from one end of said hopper to the other to push the refuse from the hopper into the storage chamber, the arrangement being such that, when said hopper is moved to its second position, the axis of the cylindrical shaped hopper base is coincident with the pivot axis of said scoop and an outer, free edge of said scoop is located at the rear edge of said curved hopper base, said scoop having a length from its pivot axis to its outer, free edge substantially equal to the radius of said cylindrical shaped base, said packing means having a discharge stroke which causes the outer, free edge of said scoop to move in a path substantially coincident with the surface of the curved hopper base to sweep the refuse from the hopper.

2. A refuse collection vehicle according to claim 1 wherein a clearance of about ½ inch is present between said outer free edge of the scoop and the surface of said curved hopper base during the discharge stroke of the packing means through the hopper.

3. A refuse collection vehicle according to claim 1 which additionally comprises a tail gate having side walls which is pivotally mounted on the rear of the body of said vehicle, said tail gate being adapted for upward movement fro removal of the refuse and said hopper being mounted on said tail gate.

4. A refuse collection vehicle according to claim 3 wherein the sides of said hopper are situated inwardly of the side walls of said tail gate whereby the whole of said hopper is swept by said scoop during the discharge stroke of said packing means, said scoop being maintained clear of the side walls of said tail gate.

5. A refuse collection vehicle according to claim 3 wherein said packing means is adapted to be moved by means of hydraulic jacks located outside the side walls of said tail gate so as to avoid contact between the hydraulic jacks and the refuse, the movement of said packing means causing said refuse to be pushed from said hopper and packed under pressure into said storage chamber.

* * * * *